US012543900B2

(12) United States Patent
Moss et al.

(10) Patent No.: US 12,543,900 B2
(45) **Date of Patent: *Feb. 10, 2026**

(54) ROTATING SHOWER ROD

(71) Applicant: House of Atlas, LLC, Evanston, IL (US)

(72) Inventors: Jason Moss, Libertyville, IL (US); Alan Arthur Ford, Sturgis, MI (US)

(73) Assignee: House of Atlas, LLC, Evanston, IL (US)

( * ) Notice: Subject to any disclaimer, the term of this patent is extended or adjusted under 35 U.S.C. 154(b) by 138 days.

This patent is subject to a terminal disclaimer.

(21) Appl. No.: 18/523,306

(22) Filed: Nov. 29, 2023

(65) Prior Publication Data

US 2024/0090711 A1 Mar. 21, 2024

Related U.S. Application Data

(63) Continuation of application No. 16/852,036, filed on Apr. 17, 2020, now Pat. No. 11,889,958.

(60) Provisional application No. 62/835,205, filed on Apr. 17, 2019.

(51) Int. Cl.

| | |
|---|---|
| ***A47K 3/38*** | (2006.01) |
| ***A47H 1/02*** | (2006.01) |
| ***A47H 1/122*** | (2006.01) |

(52) U.S. Cl.

CPC ..... *A47K 3/38* (2013.01); *A47H 1/02* (2013.01); *A47H 1/122* (2013.01); *A47H 2001/0205* (2013.01)

(58) Field of Classification Search

CPC . A47K 3/38; A47H 1/02; A47H 1/122; A47H 1/022; A47H 1/142; A47H 2001/0205

See application file for complete search history.

(56) References Cited

U.S. PATENT DOCUMENTS

| | | | |
|---|---|---|---|
| 666,467 | A | 1/1901 | Clark |
| 961,352 | A | 6/1910 | Walters |
| 1,062,478 | A | 5/1913 | Kroder |
| 1,374,026 | A | 4/1921 | Nelson |
| 1,401,727 | A | 12/1921 | Pimlott |
| 1,679,881 | A | 8/1928 | Simpson |
| 1,756,716 | A | 4/1930 | Whitney |

(Continued)

FOREIGN PATENT DOCUMENTS

| | | | |
|---|---|---|---|
| WO | 2012072988 | 6/2012 | |
| WO | WO-2012072988 A2 * | 6/2012 | ..... A47K 3/38 |

OTHER PUBLICATIONS

Curved Shower Rod—Amazon, <https://www.amazon.com/Rotating-Curved-Shower-Rod-Bathrooms/dp/B07GQ4TKFP/ref=sr_1_3_sspa?dchild=1&keywords=SHOWER+ROD+CURVED+FLIP&qid=1610556970&sr=8-3-spons&psc=1&smid=AQCFIMOGZOT1J&spLa=ZW5jcnlwdGVkUXVhbGImaVWVyPUEyUzQwNkJNWUIYMUSEJmVuY3J5cHRIZEIkPUEwMzAyNzMONOVBMIRHMjVETDNZJmVuY3J5cHRIZEFKSWQ9QTA1MDU2NzYyVDgwUTZCVORRUtQJndpZGdldE5hbWU9c3BfYXRmJmFjdGlvbj1jbGlja1JIZGlyZWN0JmRvTm90TG9nQ2xpY2s9dHJ1ZQ==>, publicly available before Jul. 30, 2019, 2 pages.

(Continued)

*Primary Examiner* — Abe Massad

(74) *Attorney, Agent, or Firm* — Fitch, Even, Tabin & Flannery LLP

(57) ABSTRACT

A rotating shower rod is provided to change the location of a curved shower rod between one position projecting outward from shower or bathtub enclosure to a second position projecting inward to the enclosure. Surface mounts provide two axes of rotation for the shower rod. The shower rod includes two tubes that telescopically extend and retract relative to one another.

20 Claims, 13 Drawing Sheets

(56) References Cited

U.S. PATENT DOCUMENTS

| | | | |
|---|---|---|---|
| 1,837,340 | A | 12/1931 | Schwartz |
| 1,951,660 | A | 3/1934 | Klaudt |
| 2,011,662 | A | 8/1935 | Thompson |
| 2,275,330 | A | 3/1942 | Tveten |
| 2,293,168 | A | 8/1942 | Pirone |
| 2,554,106 | A | 5/1951 | Heubeck |
| 2,637,555 | A | 5/1953 | Klaudt |
| 2,661,850 | A | 12/1953 | Fowler et al. |
| 2,903,141 | A | 9/1959 | Seewack |
| 2,974,806 | A | 3/1961 | Seewack |
| 3,004,743 | A | 10/1961 | Wenger |
| 3,137,393 | A | 6/1964 | Marcus |
| 3,560,032 | A | 2/1971 | Cohen et al. |
| 3,674,294 | A | 7/1972 | Kirkham |
| 4,134,703 | A | 1/1979 | Hinners |
| 4,405,111 | A | 9/1983 | Lennon |
| 4,419,026 | A | 12/1983 | Leto |
| 4,593,737 | A | 6/1986 | Clemente |
| 4,653,714 | A | 3/1987 | Andrasko, Jr. |
| 4,700,918 | A | 10/1987 | Andrasko, Jr. |
| 4,754,504 | A | 7/1988 | Cellini |
| 4,895,471 | A | 1/1990 | Geltz |
| 5,022,104 | A | 6/1991 | Miller |
| 5,031,257 | A | 7/1991 | Jeffery |
| D324,328 | S | 3/1992 | Pagan |
| D327,421 | S | 6/1992 | Pagan |
| 5,139,072 | A | 8/1992 | Marocco |
| 5,156,281 | A | 10/1992 | Schwartz |
| 5,216,766 | A | 6/1993 | Lang |
| 5,259,520 | A | 11/1993 | Roggio |
| 5,303,832 | A | 4/1994 | Tu |
| 5,330,061 | A | 7/1994 | Geltz |
| 5,333,665 | A | 8/1994 | Safar |
| 5,345,624 | A | 9/1994 | Brown, III |
| 5,433,551 | A | 7/1995 | Gordon |
| 5,549,407 | A | 8/1996 | Levi |
| 5,615,721 | A | 4/1997 | Winter |
| 5,628,356 | A | 5/1997 | Marocco |
| 5,653,057 | A | 8/1997 | Gary |
| 5,678,703 | A | 10/1997 | Sawyer |
| 5,702,010 | A | 12/1997 | Liang |
| D398,468 | S | 9/1998 | Yemini |
| 5,894,610 | A | 4/1999 | Winter |
| 5,996,674 | A | 12/1999 | Gatewood |
| D421,692 | S | 3/2000 | Wojtowicz |
| D429,934 | S | 8/2000 | Hofman |
| 6,216,287 | B1 | 4/2001 | Wise |
| D443,162 | S | 6/2001 | Winter |
| D443,813 | S | 6/2001 | Harwanko |
| 6,250,839 | B1 | 6/2001 | Lenhart |
| D450,947 | S | 11/2001 | Walker |
| D456,167 | S | 4/2002 | Harwanko |
| 6,443,207 | B1 | 9/2002 | Cheng |
| D466,798 | S | 12/2002 | Rebman |
| D466,799 | S | 12/2002 | Suero, Jr. |
| D470,332 | S | 2/2003 | Clucas |
| 6,520,351 | B1 | 2/2003 | Zadro |
| D472,453 | S | 4/2003 | Rebman |
| 6,543,629 | B1 | 4/2003 | Samelson |
| D475,551 | S | 6/2003 | Kelso |
| D475,561 | S | 6/2003 | Suero, Jr. |
| D475,562 | S | 6/2003 | Suero, Jr. |
| 6,581,790 | B1 | 6/2003 | Zadro |
| 6,640,867 | B1 | 11/2003 | Pallotta |
| 6,651,831 | B2 | 11/2003 | Samelson |
| D483,251 | S | 12/2003 | Suero, Jr. |
| 6,681,831 | B1 | 1/2004 | Cheng |
| 6,694,543 | B2 | 2/2004 | Moore |
| D491,448 | S | 6/2004 | Rebman |
| 6,761,202 | B1 | 7/2004 | Cheng |
| D494,052 | S | 8/2004 | Winter |
| D494,455 | S | 8/2004 | Winter |
| D494,845 | S | 8/2004 | Winter |
| 6,823,925 | B2 | 11/2004 | Militello |
| 6,824,000 | B2 | 11/2004 | Samelson |
| D499,329 | S | 12/2004 | Suero, Jr. |
| D500,670 | S | 1/2005 | Rebman |
| 6,845,955 | B1 | 1/2005 | Hsu |
| D501,737 | S | 2/2005 | Clucas |
| D501,738 | S | 2/2005 | Clucas |
| 6,865,817 | B2 | 3/2005 | Militello |
| D504,310 | S | 4/2005 | Harwanko |
| D504,807 | S | 5/2005 | Harwanko |
| D505,062 | S | 5/2005 | Suero, Jr. |
| D505,317 | S | 5/2005 | Harwanko |
| D507,129 | S | 7/2005 | Harwanko |
| 6,948,545 | B1 | 9/2005 | Cheng |
| 6,959,752 | B2 | 11/2005 | Huang |
| 6,962,186 | B2 | 11/2005 | Hsu |
| 6,966,353 | B2 | 11/2005 | Hsu |
| D513,142 | S | 12/2005 | Suero, Jr. |
| D513,373 | S | 1/2006 | Harwanko |
| 6,994,143 | B2 | 2/2006 | McCarty |
| 7,000,521 | B1 | 2/2006 | Cheng |
| 7,000,787 | B2 | 2/2006 | Felsenthal |
| D516,902 | S | 3/2006 | Harwanko |
| D522,844 | S | 6/2006 | Harwanko |
| D522,845 | S | 6/2006 | Suero |
| D522,846 | S | 6/2006 | Suero, Jr. |
| D522,847 | S | 6/2006 | Suero, Jr. |
| D525,115 | S | 7/2006 | Harwanko |
| D525,813 | S | 8/2006 | Beasley |
| D526,520 | S | 8/2006 | Clucas |
| D527,246 | S | 8/2006 | Clucas |
| D534,793 | S | 1/2007 | Suero, Jr. |
| D538,571 | S | 3/2007 | Militello |
| D539,064 | S | 3/2007 | Militello |
| 7,194,811 | B2 | 3/2007 | Militello |
| 7,195,051 | B2 | 3/2007 | Nien |
| D542,392 | S | 5/2007 | Hanley |
| D542,897 | S | 5/2007 | Harwanko |
| D543,747 | S | 6/2007 | Harwanko |
| D543,748 | S | 6/2007 | Harwanko |
| D544,786 | S | 6/2007 | Barrese |
| D545,180 | S | 6/2007 | Harwanko |
| 7,225,850 | B2 | 6/2007 | McCarty |
| D547,165 | S | 7/2007 | Barrese |
| D547,166 | S | 7/2007 | Barrese |
| D547,167 | S | 7/2007 | Barrese |
| D548,574 | S | 8/2007 | Harwanko |
| 7,255,149 | B2 | 8/2007 | Rossato |
| D551,010 | S | 9/2007 | Woodhouse |
| 7,264,035 | B2 | 9/2007 | Rossato |
| D562,608 | S | 2/2008 | Kramer |
| D562,609 | S | 2/2008 | Kramer |
| 7,331,370 | B1 | 2/2008 | Militello |
| D563,136 | S | 3/2008 | Kramer |
| D563,138 | S | 3/2008 | Kramer |
| 7,346,940 | B1 | 3/2008 | Liao |
| D566,991 | S | 4/2008 | Harwanko |
| D568,656 | S | 5/2008 | Kramer |
| D569,149 | S | 5/2008 | Walker |
| D569,668 | S | 5/2008 | Kramer |
| D571,136 | S | 6/2008 | Kramer |
| D573,386 | S | 7/2008 | Clucas |
| D573,387 | S | 7/2008 | Walker |
| D576,475 | S | 9/2008 | Didehvar |
| D576,476 | S | 9/2008 | Didehvar |
| D586,647 | S | 2/2009 | Didehvar |
| D591,142 | S | 4/2009 | Cittadino |
| 7,549,615 | B2 | 6/2009 | Shevick |
| 7,562,689 | B1 | 7/2009 | Militello |
| 7,600,549 | B2 | 10/2009 | Cheng |
| 7,641,161 | B2 | 1/2010 | Bauer |
| 7,665,500 | B2 | 2/2010 | Rossato |
| D611,328 | S | 3/2010 | Hanley |
| 7,819,166 | B2 | 10/2010 | Militello |
| D628,000 | S | 11/2010 | Lindo |
| 7,857,151 | B2 | 12/2010 | Barrese |
| D632,513 | S | 2/2011 | Cittadino |
| D632,514 | S | 2/2011 | Didehvar |
| D632,515 | S | 2/2011 | Cittadino |
| 7,877,824 | B2 | 2/2011 | Grant |
| D633,780 | S | 3/2011 | Barrese |

(56) References Cited

U.S. PATENT DOCUMENTS

| | | | |
|---|---|---|---|
| D635,807 | S | 4/2011 | Lindo |
| D636,660 | S | 4/2011 | Colleen |
| 7,926,127 | B2 | 4/2011 | Barrese |
| 7,931,160 | B2 | 4/2011 | Newbouild |
| D640,488 | S | 6/2011 | Didehvar |
| 7,958,577 | B2 | 6/2011 | Chang |
| D641,190 | S | 7/2011 | Cittadino |
| D641,191 | S | 7/2011 | Walker |
| D641,193 | S | 7/2011 | Vaccaro |
| D641,194 | S | 7/2011 | Vaccaro |
| 7,984,814 | B2 | 7/2011 | Didehvar |
| D643,236 | S | 8/2011 | Kyle |
| D643,657 | S | 8/2011 | Cittadino |
| D644,050 | S | 8/2011 | Cittadino |
| 7,987,534 | B2 | 8/2011 | Lin |
| D647,391 | S | 10/2011 | Barrese |
| D648,619 | S | 11/2011 | Lowe |
| D648,969 | S | 11/2011 | Cittadino |
| D649,352 | S | 11/2011 | Cittadino |
| 8,056,873 | B1 | 11/2011 | Hanely |
| D650,263 | S | 12/2011 | Barrese |
| 8,069,507 | B2 | 12/2011 | Didehvar |
| 8,069,508 | B2 | 12/2011 | O'Connell |
| 8,069,999 | B2 | 12/2011 | Kaveh |
| D652,236 | S | 1/2012 | Walker |
| D652,237 | S | 1/2012 | Cittadino |
| D653,067 | S | 1/2012 | Cittadino |
| 8,113,361 | B2 | 2/2012 | Winter |
| 8,146,182 | B2 | 4/2012 | Bauer |
| 8,157,111 | B2 | 4/2012 | Didehvar |
| D660,064 | S | 5/2012 | Webb |
| D660,065 | S | 5/2012 | Webb |
| D660,066 | S | 5/2012 | Webb |
| 8,166,583 | B1 | 5/2012 | Liang |
| 8,185,981 | B2 | 5/2012 | Didehvar |
| D661,529 | S | 6/2012 | Cittadino |
| D661,927 | S | 6/2012 | Cittadino |
| 8,205,760 | B2 | 6/2012 | Chang |
| D664,423 | S | 7/2012 | Cittadino |
| D664,424 | S | 7/2012 | Cittadino |
| 8,214,938 | B2 | 7/2012 | Hanley |
| 8,215,501 | B2 | 7/2012 | Trettin |
| 8,225,946 | B2 | 7/2012 | Yang |
| D666,012 | S | 8/2012 | Walker |
| D667,246 | S | 9/2012 | Cittadino |
| D667,295 | S | 9/2012 | Harwanko |
| D670,521 | S | 11/2012 | Cittadino |
| D670,522 | S | 11/2012 | Cittadino |
| D670,944 | S | 11/2012 | Cittadino |
| D671,347 | S | 11/2012 | Cittadino |
| D671,348 | S | 11/2012 | Cittadino |
| D671,395 | S | 11/2012 | Harwanko |
| D672,178 | S | 12/2012 | Walker |
| D672,990 | S | 12/2012 | Lindo |
| D672,991 | S | 12/2012 | Cittadino |
| 8,341,775 | B2 | 1/2013 | Didehvar |
| 8,347,936 | B2 | 1/2013 | Martin |
| 8,348,072 | B2 | 1/2013 | Whitehall |
| D680,421 | S | 4/2013 | Martin |
| 8,408,405 | B2 | 4/2013 | Yang |
| D681,422 | S | 5/2013 | Lindo |
| D681,423 | S | 5/2013 | Walker |
| D684,037 | S | 6/2013 | Harwanko |
| 8,479,932 | B2 | 7/2013 | Carney |
| 8,505,129 | B2 | 8/2013 | Parker |
| 8,522,373 | B2 | 9/2013 | Bauer |
| 8,528,753 | B2 | 9/2013 | Woolley, II |
| D691,029 | S | 10/2013 | Didehvar |
| D691,030 | S | 10/2013 | Lindo |
| D691,031 | S | 10/2013 | Harwanko |
| 8,561,667 | B1 | 10/2013 | Hanley |
| D693,209 | S | 11/2013 | Walker |
| 8,573,416 | B2 | 11/2013 | Didehvar |
| 8,578,995 | B2 | 11/2013 | Nelson |
| D696,573 | S | 12/2013 | Didehvar |
| D702,112 | S | 4/2014 | Cittadino |
| 8,739,324 | B2 | 6/2014 | Napier |
| 8,763,821 | B2 | 7/2014 | Yang |
| 8,763,822 | B2 | 7/2014 | Didehvar |
| 8,800,072 | B2 | 8/2014 | Chang |
| 8,806,670 | B2 | 8/2014 | O'Connell |
| 8,814,114 | B2 | 8/2014 | Baines |
| 8,827,587 | B2 | 9/2014 | Didehvar |
| 8,839,980 | B2 | 9/2014 | Baines |
| D714,571 | S | 10/2014 | Walker |
| 8,851,305 | B2 | 10/2014 | Didehvar |
| 8,851,435 | B1 | 10/2014 | Bastien |
| 8,869,999 | B2 | 10/2014 | Lindo |
| 8,875,770 | B1 | 11/2014 | Martin |
| 8,960,456 | B2 | 2/2015 | Didehvar |
| 8,978,228 | B2 | 3/2015 | Didehvar |
| 8,991,625 | B2 | 3/2015 | Bucklew |
| 9,009,878 | B2 | 4/2015 | Baines |
| D729,618 | S | 5/2015 | Bastien |
| D730,162 | S | 5/2015 | Bastien |
| 9,021,627 | B2 | 5/2015 | Parker |
| 9,033,163 | B2 | 5/2015 | Hsu |
| 9,066,637 | B2 | 6/2015 | Zeng |
| 9,107,495 | B2 | 8/2015 | Lindo |
| 9,107,496 | B2 | 8/2015 | Lindo |
| 9,107,529 | B2 | 8/2015 | Didehvar |
| 9,107,544 | B2 | 8/2015 | Cittadino |
| 9,131,795 | B2 | 9/2015 | Didehvar |
| 9,161,664 | B2 | 10/2015 | Zeng |
| 9,204,764 | B1 | 12/2015 | Hanley |
| D746,667 | S | 1/2016 | Vaccaro |
| 9,271,592 | B2 | 3/2016 | Didehvar |
| 9,339,151 | B2 | 5/2016 | Yang |
| 9,357,860 | B1 | 6/2016 | Klowan |
| 9,388,837 | B1 | 7/2016 | Hanley |
| 9,474,421 | B2 | 10/2016 | Baines |
| 9,554,674 | B2 | 1/2017 | Forrest |
| 9,578,995 | B2 | 2/2017 | Hanley |
| 9,693,660 | B1 | 7/2017 | Stelmarski |
| 9,770,138 | B2 | 9/2017 | Engell |
| 9,808,125 | B2 | 11/2017 | Jepson |
| D811,205 | S | 2/2018 | Hanley |
| 9,883,742 | B2 | 2/2018 | Yang |
| D813,021 | S | 3/2018 | Hanley |
| D813,022 | S | 3/2018 | Hanley |
| 9,943,192 | B2 | 4/2018 | Yang |
| 9,999,322 | B2 | 6/2018 | Hain |
| 10,034,587 | B1 | 7/2018 | Elliot |
| 10,051,985 | B2 | 8/2018 | Jones |
| 10,064,523 | B2 | 9/2018 | Engell |
| 10,070,748 | B2 | 9/2018 | Hanley |
| 10,092,126 | B2 | 10/2018 | Baines |
| 10,098,508 | B1 | 10/2018 | Switzer |
| D834,925 | S | 12/2018 | Hanley |
| D834,926 | S | 12/2018 | Hanley |
| D834,927 | S | 12/2018 | Hanley |
| D847,613 | S | 5/2019 | Hanley |
| 10,278,529 | B2 | 5/2019 | Baines |
| D856,785 | S | 8/2019 | Hanley |
| D858,259 | S | 9/2019 | Hanley |
| D858,260 | S | 9/2019 | Hanley |
| D859,963 | S | 9/2019 | Hanley |
| 10,463,199 | B2 | 11/2019 | Coratolo |
| 10,485,383 | B2 | 11/2019 | Worden, IV |
| 10,595,683 | B1 | 3/2020 | Stelmarski |
| 10,758,091 | B2 | 9/2020 | Engell |
| 11,622,655 | B2 * | 4/2023 | Chen ..... A47K 3/38 4/610 |
| 11,889,958 | B2 | 2/2024 | Moss |
| 2003/0209509 | A1 | 11/2003 | Felsenthal |
| 2004/0182806 | A1 | 9/2004 | Figueroa |
| 2005/0263655 | A1 | 12/2005 | Bauer |
| 2005/0268394 | A1 | 12/2005 | Monk |
| 2006/0070177 | A1 | 4/2006 | Bathurst |
| 2006/0156465 | A1 | 7/2006 | Lavi |
| 2006/0204322 | A1 | 9/2006 | Roiser |
| 2006/0218717 | A1 | 10/2006 | van den Bosch |
| 2007/0006377 | A1 | 1/2007 | Moore |
| 2007/0006378 | A1 | 1/2007 | Moore |

(56) References Cited

U.S. PATENT DOCUMENTS

| | | | |
|---|---|---|---|
| 2007/0169260 | A1 | 7/2007 | Huang |
| 2007/0170134 | A1 | 7/2007 | Bishop |
| 2007/0174956 | A1 | 8/2007 | Heaslip |
| 2008/0022451 | A1 | 1/2008 | Urlich |
| 2008/0028513 | A1 | 2/2008 | Didehvar |
| 2008/0115265 | A1 | 5/2008 | Heaslip |
| 2008/0163418 | A1 | 7/2008 | Barrese |
| 2009/0083905 | A1 | 4/2009 | O'Connell |
| 2009/0223642 | A1 | 9/2009 | Militello |
| 2009/0223917 | A1 | 9/2009 | Grant |
| 2010/0206492 | A1 | 8/2010 | Shevick |
| 2010/0316438 | A1 | 12/2010 | Sohn |
| 2011/0198045 | A1 | 8/2011 | Wieland |
| 2011/0284484 | A1 | 11/2011 | Lin |
| 2012/0005823 | A1 | 1/2012 | Baines |
| 2012/0017366 | A1 | 1/2012 | Barrese |
| 2012/0036628 | A1 | 2/2012 | O'Connell |
| 2012/0152872 | A1 | 6/2012 | Didehvar |
| 2012/0152873 | A1 | 6/2012 | Didehvar |
| 2012/0152874 | A1 | 6/2012 | Didehvar |
| 2012/0217215 | A1 | 8/2012 | Emery |
| 2012/0241399 | A1 | 9/2012 | Trettin |
| 2012/0284914 | A1 | 11/2012 | Bauer |
| 2013/0045041 | A1 | 2/2013 | Sohn |
| 2013/0112639 | A1 | 5/2013 | Baines |
| 2013/0334156 | A1 | 12/2013 | Baines |
| 2013/0341474 | A1 | 12/2013 | Baines |
| 2014/0124598 | A1 | 5/2014 | Vaccaro |
| 2014/0131298 | A1 | 5/2014 | Didehvar |
| 2014/0166603 | A1 | 6/2014 | Baines |
| 2014/0224754 | A1 | 8/2014 | Baines |
| 2014/0263123 | A1 | 9/2014 | Ford |
| 2014/0317840 | A1 | 10/2014 | O'Connell |
| 2014/0360959 | A1 | 12/2014 | Didehvar |
| 2014/0360960 | A1 | 12/2014 | Didehvar |
| 2015/0265086 | A1 | 9/2015 | Hanley |
| 2015/0297038 | A1 | 10/2015 | Vaccaro |
| 2016/0113447 | A1 | 4/2016 | Walker |
| 2016/0374518 | A1 | 12/2016 | Baines |
| 2017/0360261 | A1 | 12/2017 | Coratolo |
| 2018/0008101 | A1 | 1/2018 | Engell |
| 2018/0064279 | A1 | 3/2018 | Hanley |
| 2018/0098656 | A1 | 4/2018 | Baines |
| 2018/0296018 | A1 | 10/2018 | Baines |
| 2018/0306219 | A1 | 10/2018 | Hanley |
| 2019/0082875 | A1* | 3/2019 | Scanlon ..... A47H 1/022 |
| 2019/0099034 | A1 | 4/2019 | Hanley |
| 2019/0282017 | A1 | 9/2019 | Hanley |
| 2021/0378433 | A1 | 12/2021 | Berman |
| 2022/0110490 | A1 | 4/2022 | Chen |

OTHER PUBLICATIONS

Rotator Rod "Rotator Rod—Installing the Curved Shower Rod for Small Bathrooms," Published Feb. 27, 2019, <https://www.youtube.com/watch?v=y1 EB_9IEXW8>.

Rotator Rod "RotatorRod—What's in the Box 2015," Published May 7, 2015, <https://www.youtube.com/watch?v=7FBC1dN4Euw>.

Rotator Rod "Troubleshooting Your Curved Shower Rod—Rotator Rod," Published Feb. 5, 2015, <https://www.youtube.com/watch?v=4s93TRnONP4>.

* cited by examiner

ROTATING SHOWER ROD

CROSS-REFERENCE TO RELATED APPLICATIONS

This application is a continuation of U.S. patent application Ser. No. 16/852,036, filed Apr. 17, 2020, which claims the benefit of U.S. Provisional Application No. 62/835,205, filed Apr. 17, 2019, which are hereby incorporated by reference in their entireties.

FIELD

The subject matter of this application relates to shower rods and, more particularly, to rotating curved shower rods.

BACKGROUND

Shower rods are used to suspend shower curtains for shower and/or bathtub enclosures. Shower rods that curve outward from the enclosures have been used to increase the space in the enclosure. These curved shower rods have been designed to rotate from their outward curved configuration for using the enclosure to a second position curving into the enclosure to increase the usable size of the bathroom when not using the enclosure. There is a need for an improved rotating curved shower rod assembly.

DETAILED DESCRIPTION

Figure 1:
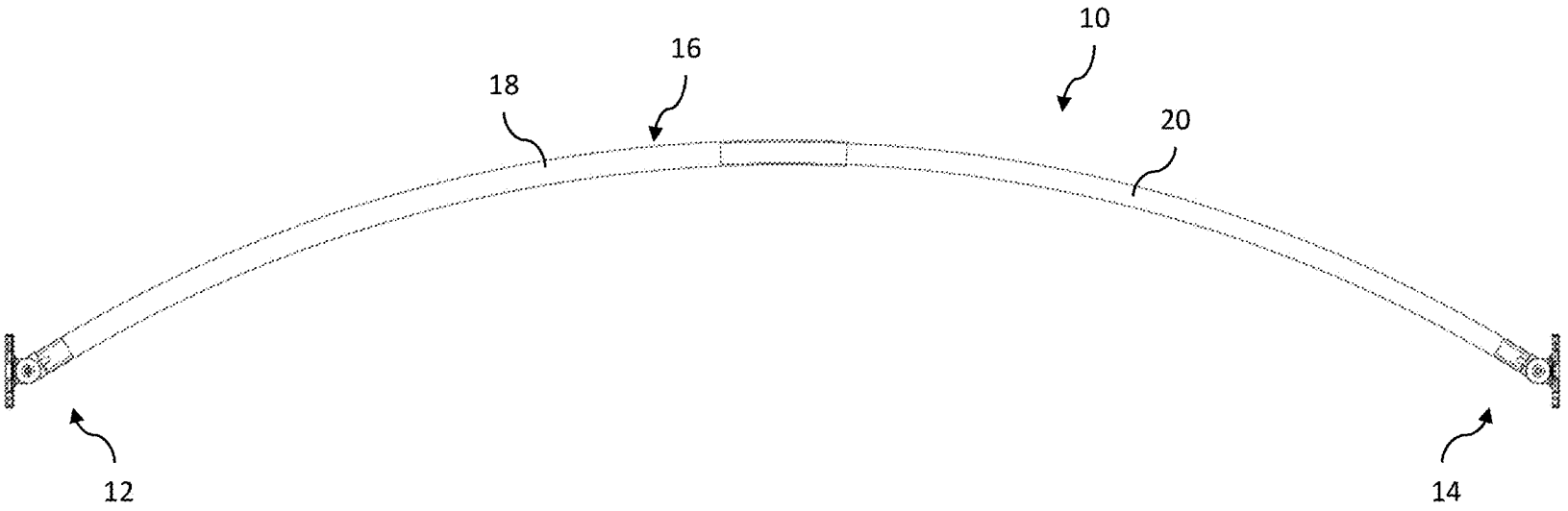
FIG. 1 is a top plan view of a shower rod assembly embodying features of the present invention.

FIG. 1 illustrates a curved rotating shower rod assembly 10. The shower rod assembly 10 supports a shower curtain.

The shower rod assembly 10 includes left and right surface mounts 12, 14. The surface mounts 12, 14 enable the shower rod assembly 10 to pivot from curving outward of a bathtub into the surrounding room to curving inward into the bathtub area. This provides the flexibility to enlarge the area in the bathtub when in use and to increase the area of the bathroom when the bathtub is not in use.

Figure 2:
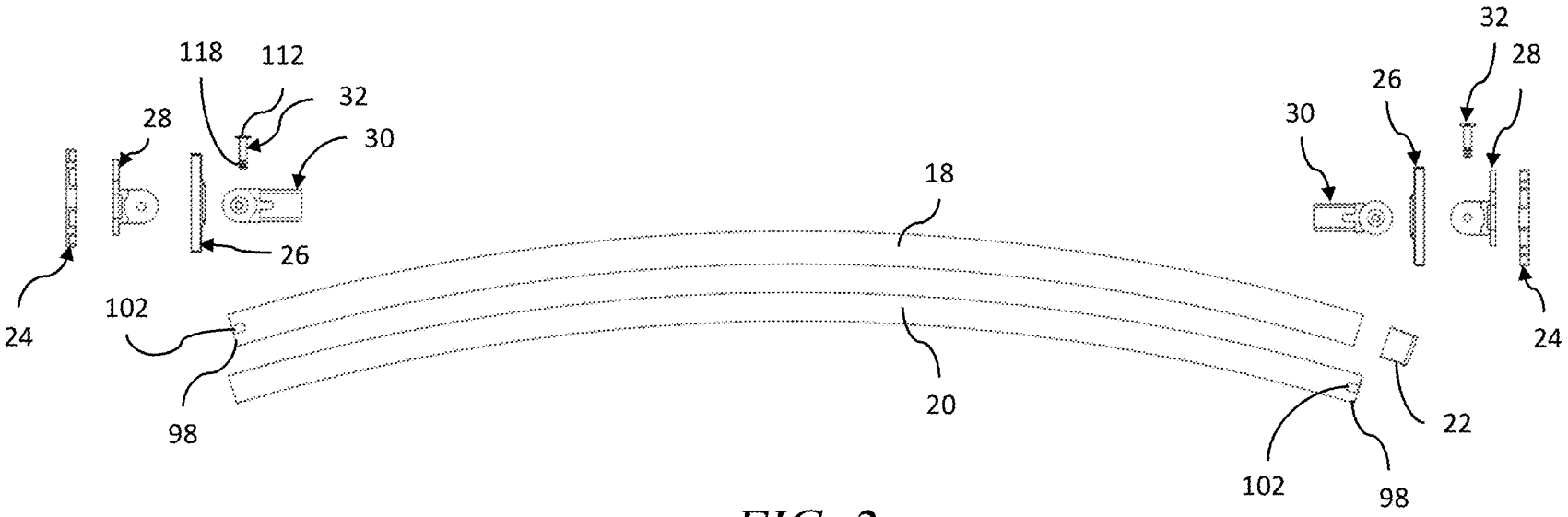
FIG. 2 is a top plan, exploded view of the shower rod assembly of FIG. 1.

With reference to FIG. 2, the shower rod assembly 10 includes a shower rod 16. The shower rod 16 may include two tubes, an outer tube 18 that receives an inner tube 20. The tubes 18, 20 slide telescopically relative to one another to adjust the length of the shower rod 16. For example, the inner tube 20 may be extended out of the outer tube 18 a certain amount to set the desired length of the rod 16. The more the tubes 18, 20 are extended relative to one another the larger the radius of curvature of the rod 16 becomes. A sleeve 22 slides along the inner tube 20, and when the tubes 18, 20 are set to the desired length for the shower rod 16, the sleeve 22 is slide so that a portion of it is inserted into the outer tube 18. The sleeve 22 helps remove any undesirable play between the tubes 18, 20. One end of each tube 18,20 includes a notch 102 that is used in connecting it to the surface mounts 12, 14, as described further below.

Figure 3:
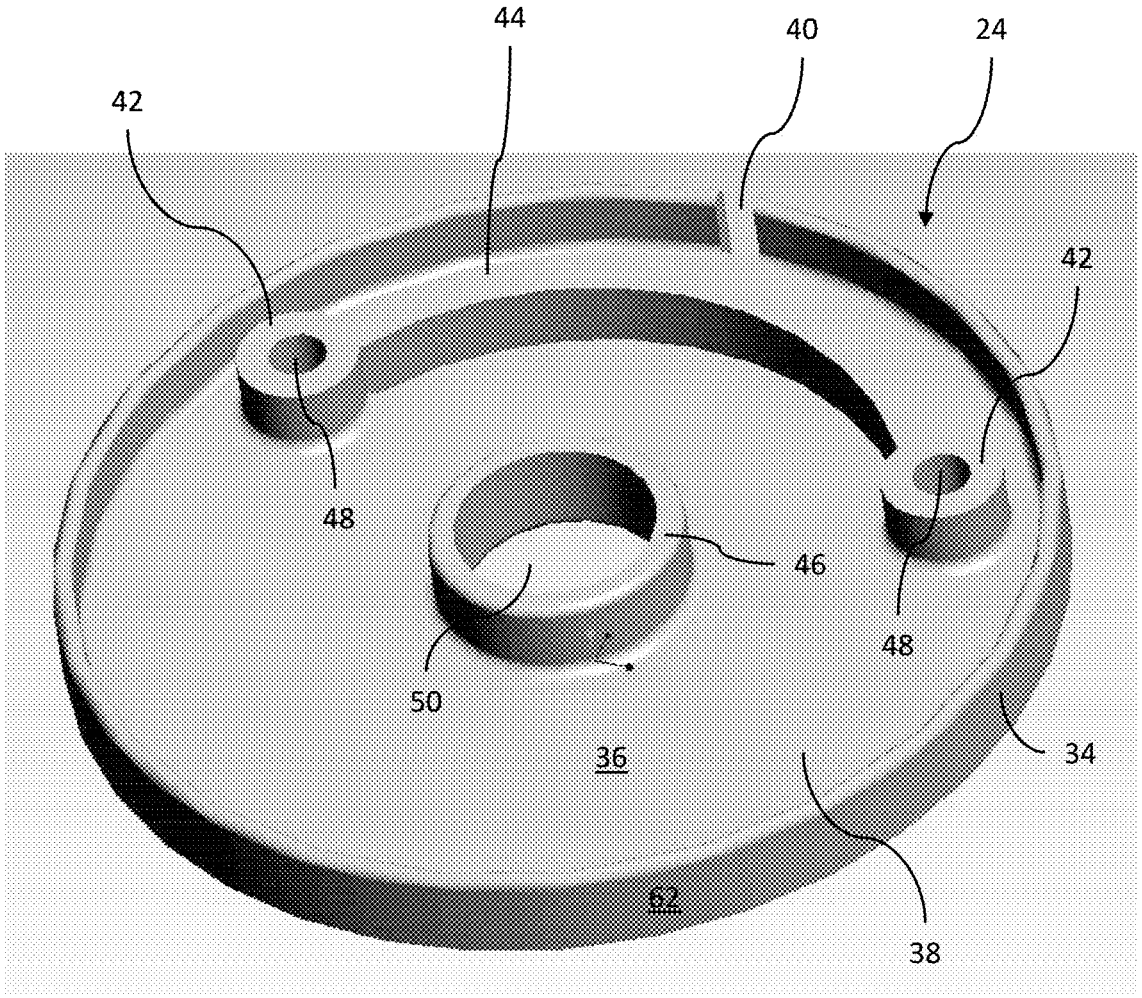
FIG. 3 is a top perspective view of a mount plate of the shower rod assembly of FIG. 1.
Figure 4A:
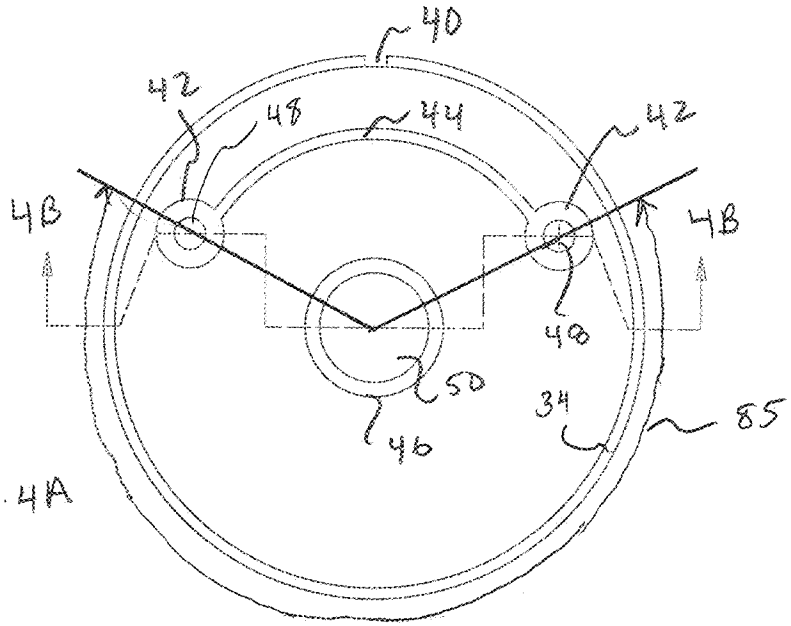
FIG. 4A is a top plan view of the mount plate of FIG. 3.
Figure 4B:
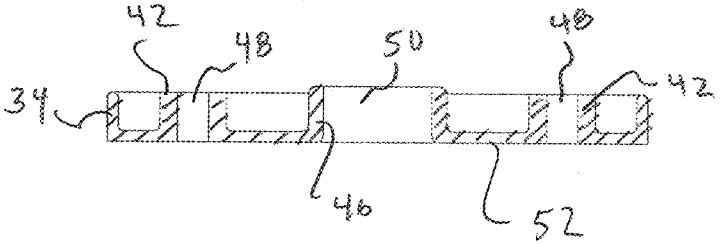
FIG. 4B is a cross-section view of the mount plate of FIG. 3 taken along line 4B-4B of FIG. 4A.

The left and right surface mounts 12, 14 each include a mount plate 24, a cover 26, a rotator plate 28, an insert, such as a tube plug, plug or insert plug 30, and a pivot pin 32. As illustrated in FIGS. 3, 4A and 4B, the mount plate 24 includes a perimeter wall 34 extending from a base 36 that defines a recess 38. The perimeter wall 34 defines a notch 40. Two small stops, such as bosses 42, extend from the base 36 into the recess 38, and an arcuate support wall 44 extends between the small bosses 42. A larger boss 46 extends from the center of the base 36. The smaller bosses 42 each define a passage 48 through the mount plate 24 for mounting screws. The larger boss 46 also defines a passage 50 through the mount plate 24. The height of the perimeter wall 34, bosses 42, 46 and arcuate support wall 44 are the same but could be different, such as less than the perimeter wall 34. A mount surface 52 of the base 26 opposite the perimeter wall 34 and bosses 42, 46 is flat in order to form a flush engagement with a mounting surface. The mount plate 24 is circular but could be any other shape.

Figure 5:
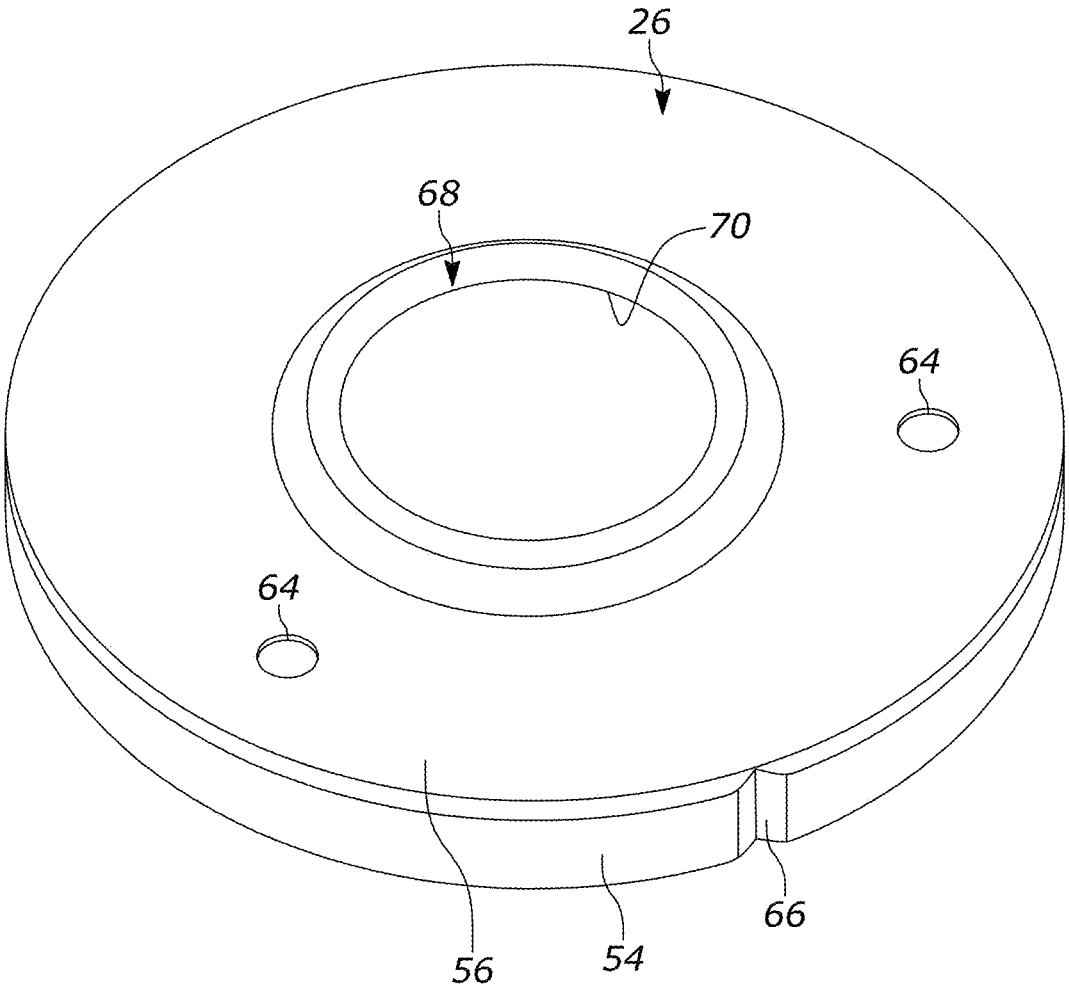
FIG. 5 is a top perspective view of a cover of the shower rod assembly of FIG. 1.
Figure 6:
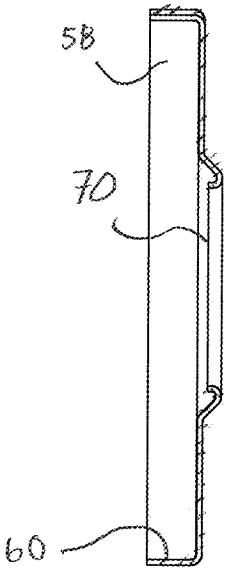
FIG. 6 is a cross-section view of the cover of FIG. 5.

As shown in FIGS. 5 and 6, the cover 26 includes a perimeter wall 54 extending from a base 56 to define a recess 58. The perimeter wall 54 includes an inner surface 60 that engages an outer surface 62 of the perimeter wall 34 of the mount plate 24. Two small holes 64 extend through the base 56 and are located to align with the small bosses 42 of the mount plate 24. The perimeter wall 54 includes a small inward projection 66 that is configured to fit into the notch 40 of the mount plate 24 to align the holes 64 with the passages 48 of the bosses 42. Mounting screws extend through the holes 64 and the passages 48 of the bosses 42 to mount the surface mounts 12, 14 to a surface. The base 56 defines a center hole 68 with a rolled inward edge 70. The rotator plate 28 extends through the center hole 66, as described below.

Figure 7:
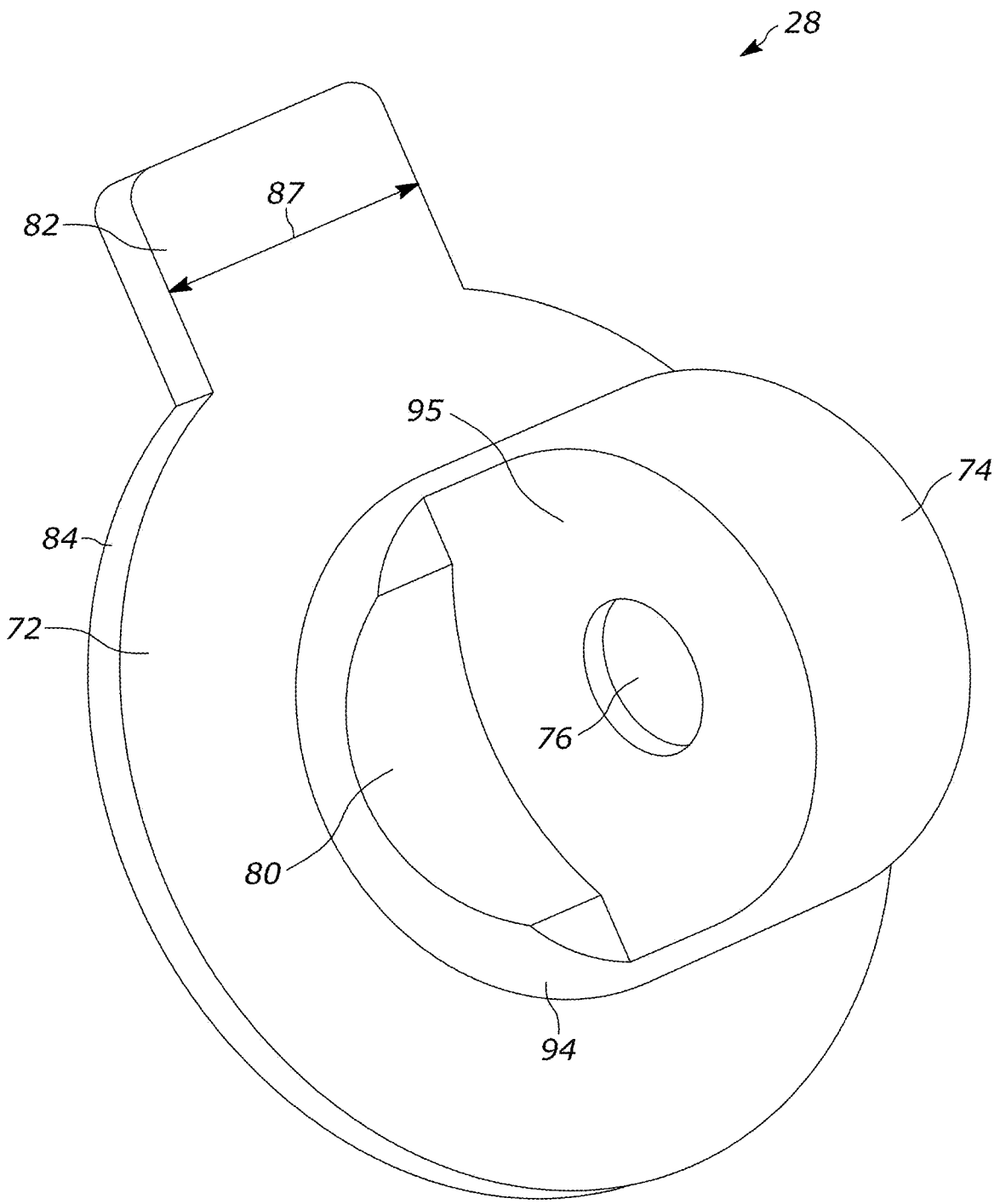
FIG. 7 is a top perspective view of a rotator plate of the shower rod assembly of FIG. 1.
Figure 8A:
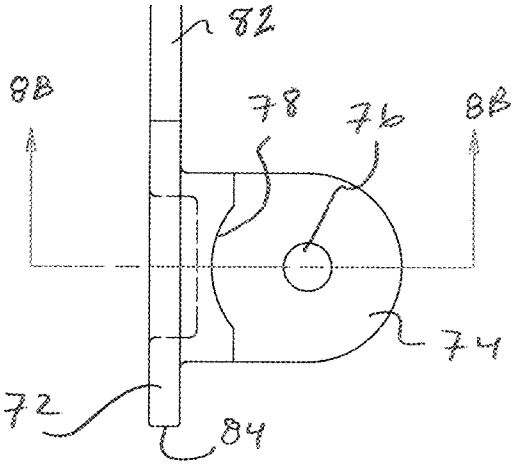
FIG. 8A is a side elevation view of the rotator plate of FIG. 7.
Figure 8B:
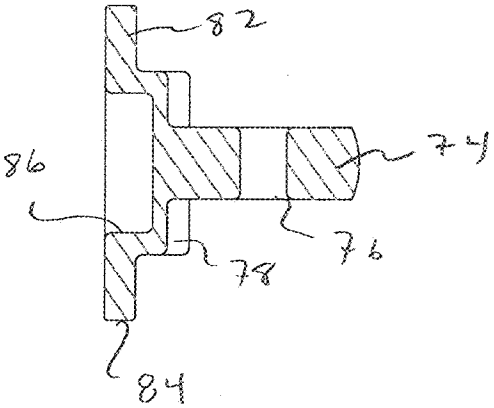
FIG. 8B is a cross-section view of the rotator plate of FIG. 7 taken along line 8B-8B of FIG. 8A.

With reference to FIGS. 7, 8A and 8B, the rotator plate 28 is located between the mount plate 24 and the cover 26 when the surface mounts 12, 14 are in the assembled condition. The rotator plate 28 includes a base portion 72 and an attachment portion 74. The attachment portion 74 extends perpendicularly from the base portion 72. The attachment portion 74 includes a circular bearing portion 94 that extends through the center hole 68 of the cover 26 when in the assembled condition. A passage 76 extends through a flat-faced, narrower portion 95 of the attachment portion 74 for use in attaching to the tube plug 30 with the pivot pin 32. The attachment portion 74 includes an arcuate base wall 80 to provide clearance for the tube plug 30 to rotate about the pin 32. The base portion 72 is preferably circular but can be other shapes.

An arm 82 extends radially from a perimeter wall 84 of the base portion 72 to limit rotation of the rotator plate 28 in the recess 38 of the mount plate 24. The size of the base portion 72 is such that it resides in the recess 38 of the rotator plate 24 inside the bosses 42 so that the arm 82 abuts the bosses 42 to prevent further rotation of the rotator plate 28. The bosses 42 are spaced to set the two positions of the shower rod 16, the outward position and inward position relative to the bathtub. For example, the outward position could be an outward horizontal position for maximizing the size of the shower or tub enclosure for showering, and the inward position could be an inward horizontal position for maximizing space in the room around the shower or tub enclosure. The bosses 42 would be set to accommodate the necessary arcuate swing 85 for the shower rod 16 to move between these two horizontal positions. To do so, the angle 85 between the center of the bosses 42 would have to be 180 degrees plus an additional amount to account for twice the arcuate width 87 of the arm 82 where the arm 82 contacts the bosses 42 and twice the radius of the bosses 42. For instance, the angle 85 between the center of the bosses 42 could be about 233 degrees where the bosses 42 each have a radius of curvature of 0.18 inches. Further, the width 87 of arm 82 can be larger or smaller depending on the strength needed to hold the torque developed from the rod 16. This also will depend on the materials used. One material may be stainless steel. On a side opposite the attachment portion 74, the base portion 72 defines a circular 86 recess that receives and engages the larger boss 46 of the mount plate 24. The larger boss 46 guides rotation of the rotator plate 28.

Figure 9:
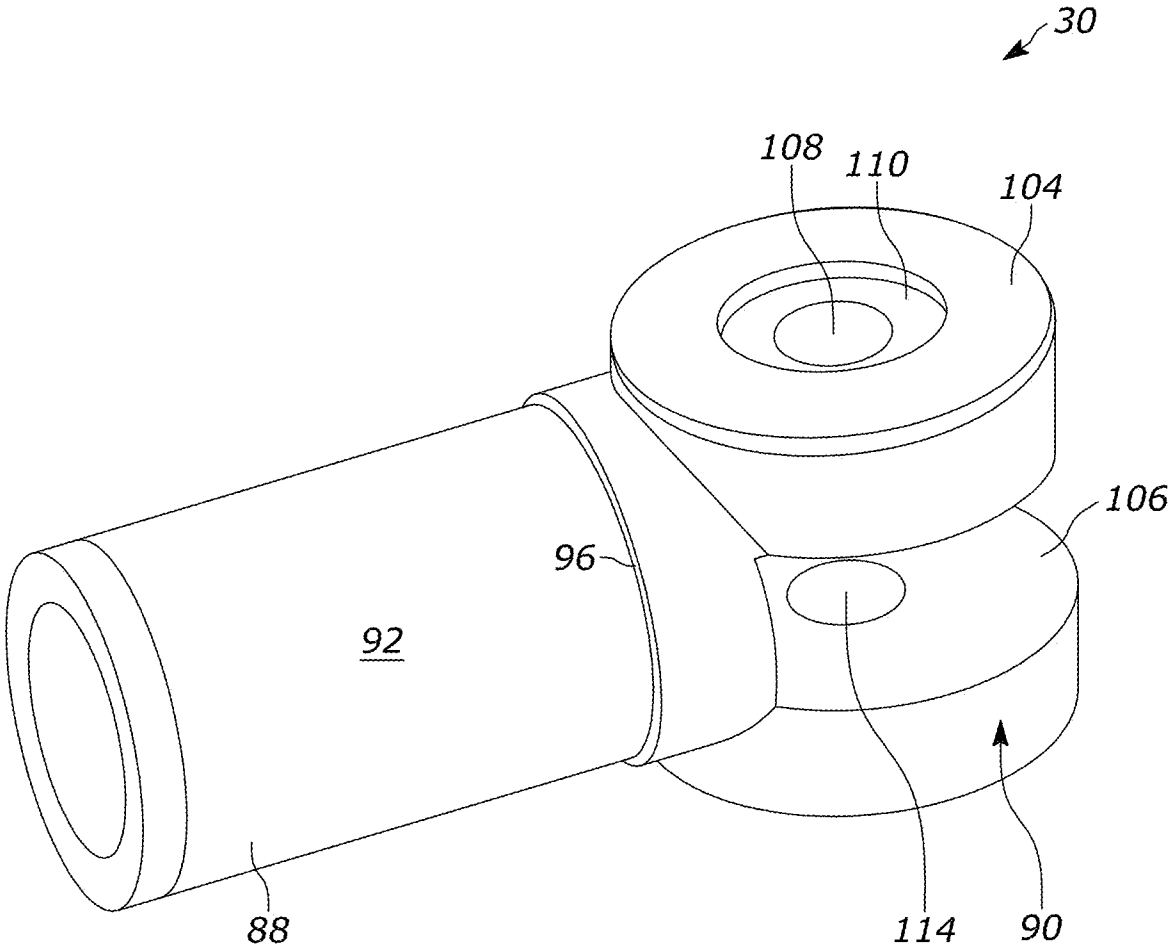
FIG. 9 is a top perspective view of a tube plug of the shower rod assembly of FIG. 1.
Figure 10A:
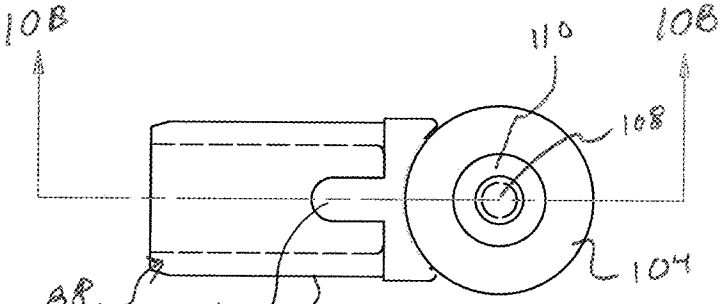
FIG. 10A is a side elevation view of the tube plug of FIG. 9.
Figure 10B:
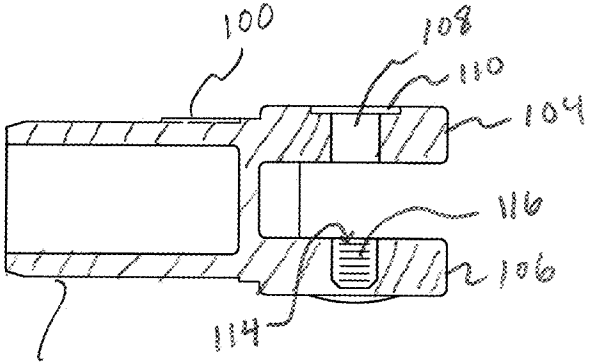
FIG. 10B is a cross-section view of the tube plug of FIG. 9 taken along line 10B-10B of FIG. 10A.

Turning to FIGS. 9, 10A and 10B, the tube plug 30 includes a cylindrical portion 88 and a yoke portion 90. The cylindrical portion 88 has an outer surface 92 that engages an inner surface of the tubes 18, 20 with a friction fit such that it remains in the tubes 18, 20. The outer diameter of one of the plugs 30 is larger than the other. The larger version is used with the outer tube 18 while the other version is used with the inner tube 20. An annular stepped edge 96 on the cylindrical portion 88 engages an end edge 98 of the tubes 18, 20 (FIG. 2) to prevent further insertion into the tubes 18, 20. The outer surface 92 also includes a short longitudinal projection 100 that aligns with and extends into a complementary notch 102 (FIG. 2) formed in the end of the tubes 18, 20. This secures the insert plugs 30 to their respective tube 18, 20 so that they rotate together. The projection 100 and notch 102 also orient the inner and outer tubes 18, 20 so that the yoke portion 90 connects to the attachment portion with the shower rod 16 in the correct orientation relative to the bosses 42. The projection 100 and the notch 102 are pre-coordinated with the arcuate spacing 85 of the bosses 42 so that the shower rod 16 is limited to a pre-determined arcuate swing, such as to inward and outward horizontal positions. The cylindrical portion 88 can be hollow to reduce material during manufacturing.

The yoke portion 90 includes a first arm 104 and a second arm 106. The arms 104, 106 are spaced to receive with slight clearance flat-faced, narrow portion 95 of the attachment portion 72 of the rotator plate 28. The clearance can be such that the parts move relative to one another but eliminate lateral wobble between them. A hole 108 extends through the first arm 104, and the hole 108 is surrounded by a recess 110 for countersinking a head 112 of the pin 32. A closed end bore 114 extends into the second arm 106. The bore 114 includes threading 116 to mesh with threading 118 on the pin 32. The hole 108 and the bore 114 align with the passage 76 of the attachment portion 74.

Figure 11:
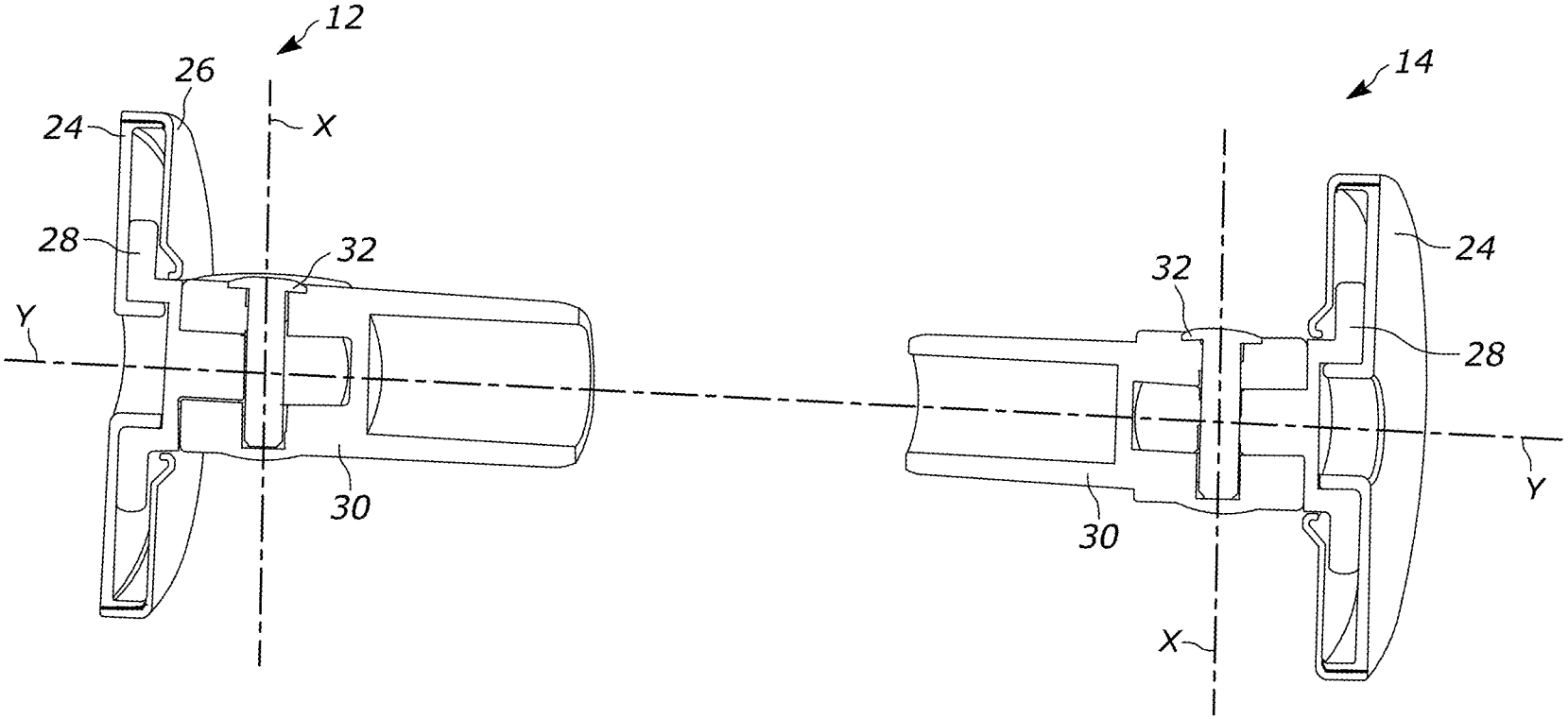
FIG. 11 is a cross-section view of left and right surface mounts of the shower rod assembly of FIG. 1.

FIG. 11 illustrates the left and right surface mounts 12, 14 in their assembled condition. The assembled surface mounts 12, 14 provide a first axis of rotation 104 via the rotator plate 28 and a second axis 106 of rotation by way of the pin 32. The two axes X, Y of rotation allow the shower rod 16 to move between its two positions.

Figure 12:
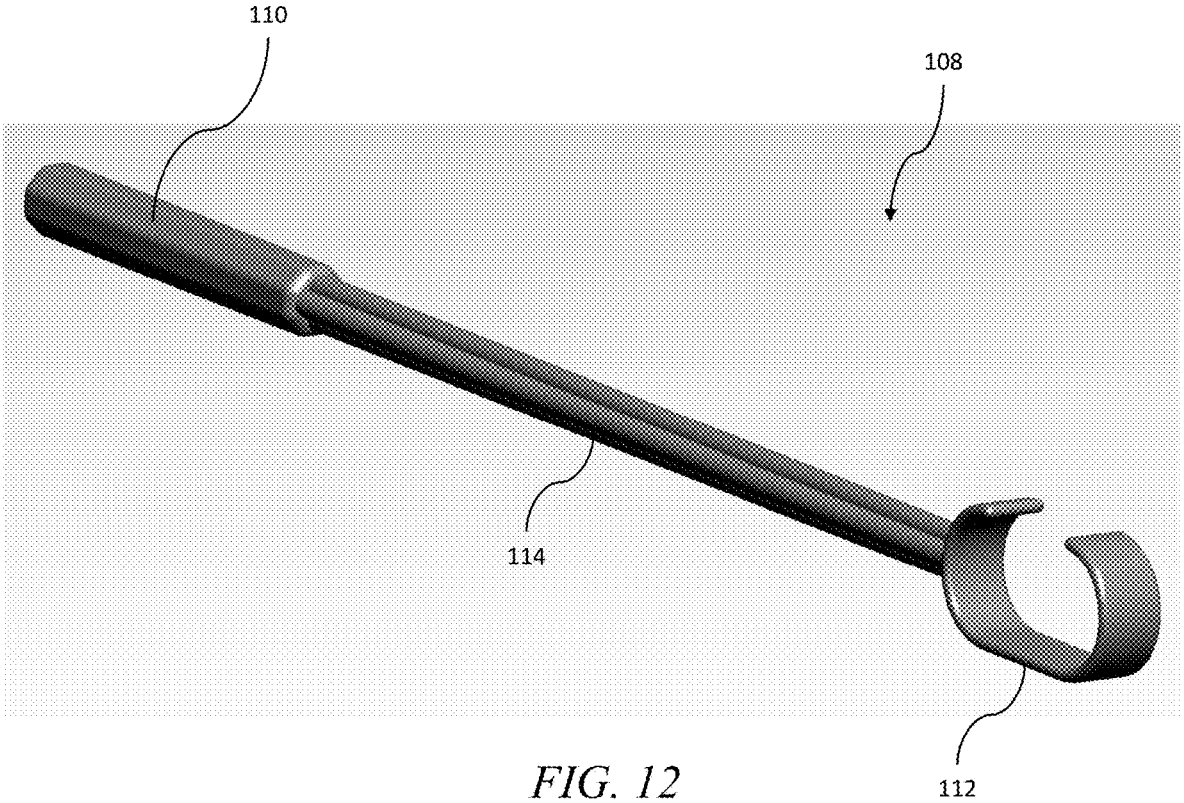
FIG. 12 is a side perspective view of a tool to be used to assist in rotating the shower rod assembly of FIG. 1.
Figure 13:
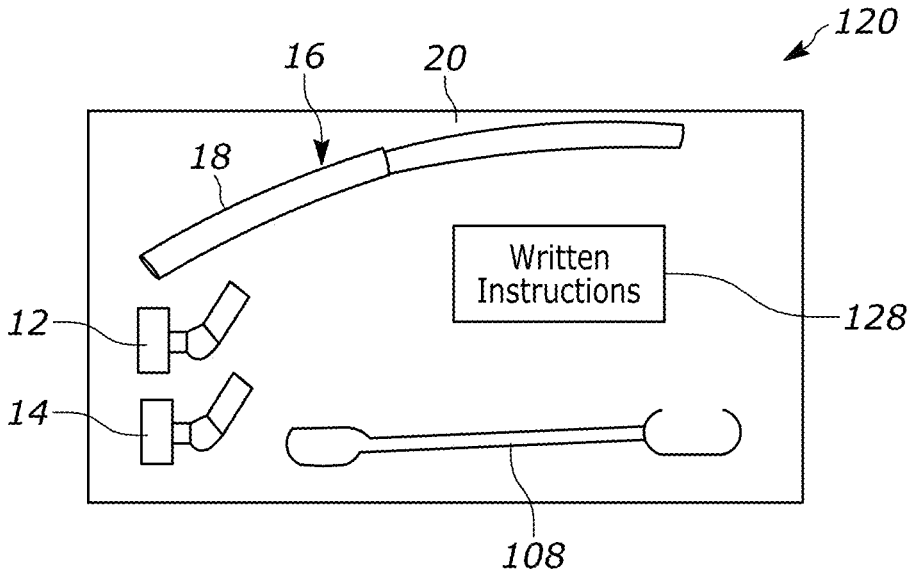
FIG. 13 is a plan view of a container containing the shower rod assembly of FIG. 1, the tool of FIG. 12, and written instructions.
Figure 14:
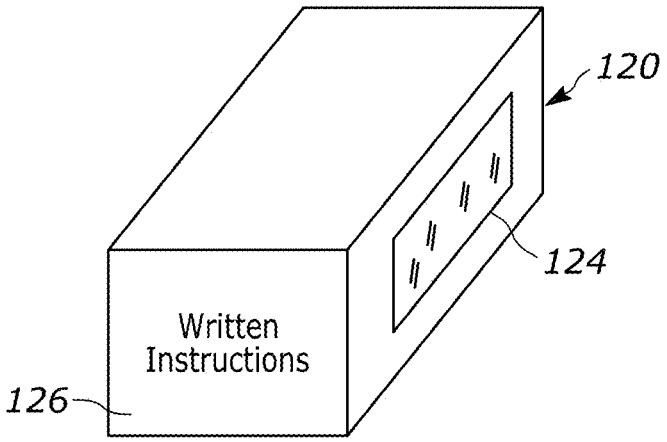
FIG. 14 is a perspective view of the container of FIG. 13 with written instructions on the container and a transparent window.

With reference to FIG. 12, there is illustrated a tool 108 to reach and assist in rotating the shower rod 16 between its two positions. The tool 108 includes a handle 110 at one end, an elongated C-shaped hook 112 at the other end, and an extension portion 114 extending between the handle 110 and the hook 112. The hook 112 can have any configuration, such as circular, triangular, rectangular, provided with a split to allow the shower rod 16 to enter into the grasp of the hook 112. The hook 112 can be used to receive the shower rod 16 through the split. Once attached to the shower rod 16, the tool 108 can be used to manually lift and rotate the shower rod 16 between the two positions. The tool 108 can be molded as a single piece component, or it can be made of multiple components.

The shower rod assembly 10 can be packaged together as a kit in a single container or packaging 120. The kit in the container 120 may also include the tool 108. The container 120 may be made of transparent material or may contain windows 124 to display some or all of the contents. The container 120 may include indicia or an indicia placard to describe some or all of the contents and/or provide instructions 126 on how to install the shower rod assembly. The instructions 128 also may be provided separate from the container and published in written form contained in the container and/or online at a website.

To install the shower rod assembly, positions on the mounting surface are first determined for the height and lateral location relative to the shower and/or bathtub enclosure for the left and right surface mounts 12, 14. The locations for the mounting screws are then located using a template provided with the kit as part of the container or the passages 48 through the bosses 42 the mount plate 24 and/or the aligned holes 64 of the cover 26 with the passages 42 of the bosses 42 of mount plate 24 of assembled left and right surface mounts 12, 14. It is desired to orient left and right surface mounts 12, 14 so that the notch 40 of the mount plate 24 and the inward projection 66 of the cover 26 are at the top (or 12:00) position. This ensures that the mounting screws are in an upper portion of the mount plate 24, which provides a more secure installation as opposed to the screws being in a lower portion. This ensures that bosses 42 provide the shower rod 16 with the intended positions, such as two horizontal positions, with the arm 82 operating in the lower portion of the mount plate 24.

The locations for the mounting screws on the mounting surface may be pre-drilled and/or prepared with other components, such as expandable inserts placed in the pre-drilled holes. The left and right surface mounts 12, 14 can be pre-assembled, such as at the supplier and/or factory, or they can be assembled as part of the installation process. Alternatively, the rotator plate 28 may be placed in the recess 38 of the mount plate 28, and the cover 26 may be placed over the mounting plate 24 and the rotator plate 28. Other fasteners, such as nails, ribbed nails and mollies, may be used. Next, the mounting screws are threaded into the pre-drilled holes or are driven directly into the surface without pre-drilling. They are tightened to secure the surface mounts 12, 14 to the mounting surface. The height of bosses 42 and the arcuate support wall 44 can be selected to prevent overtightening that would squeeze and impede rotation of the rotator plate 28.

After installation of the surface mounts 12, 14, the shower rod 16 is installed. The tube plugs 30 can already be pre-installed into the ends of the outer and inner tubes 18, 20 at the supplier and/or factory, or they can be inserted during the installation process. The outer and inner tubes 18, 20 are extended relative to one another until the narrow portions 95 of the tube plugs 30 are positioned in the yoke portion 90 of their respective attachment portion 76. The pins 32 are then installed to secure the narrow portions 95 in their respective yoke portion 90.

It will be understood that various changes in the details, materials, and arrangements of parts and components which have been herein described and illustrated in order to explain the nature of the systems and operations may be made by those skilled in the art within the principle and scope of the subject matter expressed in the appended claims. Furthermore, while various features have been described in connection with particular embodiments, it will be appreciated that features described for one embodiment also may be incorporated with the other described embodiments.

What is claimed is:

1. A rotatable shower rod system comprising:
a first mounting assembly;
a second mounting assembly;
a curved shower rod extending between the first mounting assembly and the second mounting assembly;
each of the first and second mounting assemblies including a stationary plate, a rotational plate, and a plug for insertion into the rod,
the stationary plate including a stationary base having at least one stop that limits rotation of the rotational plate, and
the rotational plate including a rotational base that engages the stationary base and an attachment projection extending axially from the rotational base, the attachment projection including a base portion projecting axially from the rotational base and a tab portion projecting axially from the base portion to engage the plug, the base portion defining at least one flange extending laterally from a first side or a second side of the tab portion.

2. The system of claim 1, wherein the attachment projection extends axially from a central portion of the rotational base.

3. The system of claim 2, wherein the base portion of the attachment projection is defined in part by an inner annular wall, and a projection of the stationary plate is receivable within the inner annular wall to guide rotation of the rotational plate relative to the stationary plate.

4. The system of claim 1, comprising a cover plate that covers the rotational base, the cover plate defining a hole and the base portion and the tab portion extending at least in part through the hole.

5. The system of claim 1, wherein the base portion includes at least one arcuate surface that provides clearance for movement of a coupling portion of the plug relative to the base portion.

6. The system of claim 5, wherein a first arcuate surface of the at least one arcuate surface is adjacent the first side of the tab portion and a second arcuate surface of the at least one arcuate surface is adjacent the second side of the tab portion.

7. The system of claim 1, wherein the stationary plate includes an arcuate wall projecting from the stationary base and spaced radially inwardly from a perimeter of the stationary base, a first end of the arcuate wall defining a first stop of the at least one stop and a second end of the arcuate wall defining a second stop of the at least one stop.

8. The system of claim 7, wherein the stationary plate includes a boss projecting from a central portion of the stationary base, and the rotational base rotates between the boss and the arcuate wall.

9. A rotatable shower rod system comprising:
a curved shower rod;
a first mounting assembly and a second mounting assembly that mount the curved shower rod to a surface;
each of the first mounting assembly and the second mounting assembly including a stationary plate, a rotational plate, and a removable cover, the removable cover having an annular portion that directly overlays an entire perimeter of the rotational plate in an axial direction such that there is no structure between the annular portion and the entire perimeter of the rotational plate in the axial direction, and the cover further including an opening, a portion of the rotational plate projecting outwardly from the cover through the opening.

10. The rotatable shower rod system of claim 9, wherein the removable cover defines at least one hole that aligns with at least one mounting passage on the stationary plate for mounting the removable cover to the stationary plate and to the surface.

11. The rotatable shower rod system of claim 9, wherein the stationary plate includes a first stop spaced from a second stop to engage the rotational plate to limit rotation of the rotational plate relative to the stationary plate.

12. The rotatable shower rod system of claim 11, wherein the first stop and the second stop each define a mounting passage for a fastener to mount the stationary plate to the surface and a tab extending from the rotational plate with a radial length that enables the tab to engage the first stop and the second stop during rotation of the rotational plate.

13. The rotatable shower rod system of claim 12, wherein the removable cover defines a first hole aligned with one of the mounting passages and a second hole aligned with another of the mounting passages for attaching the removable cover to the stationary plate and to the surface simultaneously.

14. The rotatable shower rod system of claim 9, further comprising a plug for insertion into the rod, the plug including a yoke portion and a pin for movably coupling the plug to the rotational plate.

15. The rotatable shower rod system of claim 9, wherein the curved shower rod includes a curved outer tube and a curved inner tube capable of telescopically moving into and out from the curved outer tube between at least a first combined operational length and a second combined operational length.

16. A rotatable shower rod system comprising:
a first mounting assembly;
a second mounting assembly;
a curved shower rod extending between the first mounting assembly and the second mounting assembly;
each of the first and second mounting assemblies including a stationary component and a rotational component,
the stationary component including a stationary base, a first perimeter wall projecting about the stationary base and defining a recess, a first stop and a second stop projecting axially from the stationary base within the recess to limit rotation of the rotational component relative to the stationary component, and a boss projecting from a central portion of the stationary base within the recess, and the rotational component including an annular rotational base positioned about the boss and the annular rotational base positioned entirely radially inward of the first stop and the second stop, a flange extending from the annular rotational base positioned to selectively engage the first stop or the second stop.

17. The system of claim 16, wherein the first stop and the second stop are defined by at least one projection, and the at least one projection is spaced radially inward from the first perimeter wall defining a gap therebetween.

18. The system of claim 16, wherein the stationary component includes an arcuate wall projecting from the stationary base, spaced inwardly from the first perimeter wall, a first end of the arcuate wall defining the first stop and a second end of the arcuate wall defining the second stop.

19. The system of claim 16, further comprising a cover plate having a second perimeter wall, the second perimeter wall engaging the first perimeter wall of the stationary component.

20. The system of claim 16, further comprising a plug for insertion into the rod, the plug including a yoke portion and a pin for movably coupling the plug to the rotational component.

* * * * *